US007160198B2

(12) United States Patent
Coates

(10) Patent No.: US 7,160,198 B2
(45) Date of Patent: Jan. 9, 2007

(54) METHOD AND APPARATUS FOR TRAINING A USER TO SWING A GOLF CLUB

(76) Inventor: Adam L. Coates, 1501 Cree Ct., Beaver Lake, NE (US) 68048

( * ) Notice: Subject to any disclaimer, the term of this patent is extended or adjusted under 35 U.S.C. 154(b) by 0 days.

(21) Appl. No.: 10/916,296

(22) Filed: Aug. 11, 2004

(65) Prior Publication Data

US 2006/0040758 A1 Feb. 23, 2006

(51) Int. Cl.
*A63B 69/36* (2006.01)

(52) U.S. Cl. ..... 473/220; 473/223

(58) Field of Classification Search ..... 473/219, 473/220, 221, 223, 226, 257, 409
See application file for complete search history.

(56) References Cited

U.S. PATENT DOCUMENTS 5,692,965 A 12/1997 Nighan, Jr. et al.
5,848,944 A * 12/1998 Brannen ..... 473/409
5,897,441 A * 4/1999 Apthorp ..... 473/220
5,954,592 A 9/1999 Laffer et al.
6,254,493 B1 * 7/2001 Wurster ..... 473/220
6,488,592 B1 12/2002 Boatner
6,758,760 B1 * 7/2004 Kellogg et al. ..... 473/220
2001/0027136 A1 * 10/2001 Chris ..... 473/220
2005/0009616 A1 * 1/2005 Dickie ..... 473/220

* cited by examiner

*Primary Examiner*—Nini F. Legesse
(74) *Attorney, Agent, or Firm*—Turan P. Odabasi

(57) ABSTRACT

A novel method and apparatus for teaching a user to swing a golf club is disclosed herein. A plurality of lasers are movably and securably attached to a golf club. The lasers are set at an angle away from the shaft of the club, said angle being determined by a calculation based on the swing characteristics of the user. The user places a golf ball slightly in front of a visible guideline, said guideline being positioned parallel to the user's shoulders at address of the ball and extending behind and in front of the ball. The plurality of lasers on the shaft of the club produce a plurality of laser points that appear in relation to the guideline during the swing of the club, thereby providing the user with feedback regarding the plane of their swing and the position of the club head and club face. The apparatus is also useful for teaching a user to hit draw and fade shots.

13 Claims, 14 Drawing Sheets

METHOD AND APPARATUS FOR TRAINING A USER TO SWING A GOLF CLUB

TECHNICAL FIELD

The present invention relates to the field of sports, specifically to a novel method and apparatus for training a user to swing a golf club correctly through the use of a plurality of lasers positioned on the shaft of a golf club in such a manner that the lasers will provide feedback to a user regarding the swing plane of the golf club, the position of the head of the golf club and the orientation of the face of the golf club throughout the entire swing of the club.

BACKGROUND OF THE INVENTION

Golf is a tremendously popular sport played by millions of people around the world. However, it can be a very difficult sport to learn to play. The hand-eye coordination required to swing a golf club correctly can take years to master. The popularity of the sport and the devotion of its participants have created a tremendous demand for golf training aids and devices. Furthermore, golf courses the world over employ professionals who specialize in teaching individuals how to play the game and how to swing a golf club correctly.

As the demand for training aids has increased, various golf swing training devices have been developed. These devices can be divided into two distinct categories, training devices for putting swings and training devices for non-putting swings. The present invention relates to non-putting golf swings, and all references to the swing of a golf club or a golf swing contained herein shall refer to this type of swing.

Various golf swing training devices have been developed that incorporate lasers into the design and operation of the training aid as a means to provide useful information to a user during the swing of a golf club. U.S. Pat. No. 6,488,592 discloses an apparatus and method for teaching a user to swing a golf club that uses a two-laser system to track a user's swing and provide information to the user. A laser is mounted on the butt end of the grip of a golf club so as to project a laser beam away from the butt end of the handle, and a second laser is mounted on the shaft of the club so as to project a laser beam towards the head of the club. Information is provided to the user through the swing of the club by observing the laser points generated by the lasers along a center tape line crossing through the center of a golf ball. While this apparatus does provide information to a user throughout portions of the backswing and downswing of the golf club, it does not provide information related to the position of the face of the club during the majority of the backswing or downswing, and provides only momentary information during the follow through at the completion of the swing.

Another swing training device is illustrated in U.S. Pat. No. 5,692,965, which discloses an apparatus for training a user to swing a golf club utilizing a laser attached to the shaft of a golf club that provides information to the user indicating the position and motion of the head of the golf club at the top of the backswing of the golf club. This device, however, only provides very momentary information, occurring only at the apex of the backswing. Throughout the rest of the swing, the device provides no information to the user about either the position of the club head or the plane of the swing of the club.

U.S. Pat. No. 5,954,592 discloses a golf swing training system that incorporates a laser in the butt end of the grip of a golf club so as to shine a laser beam away from the butt end of the handle. A user uses this apparatus in conjunction with a mat on which are depicted several arcuate light beam paths, such that the laser points follows a set path according to the type of shot the user wishes to make. This invention helps illustrate to a user the path of the club during the last part of the backswing and the first part of the downswing. However, it does not provide any information regarding the orientation of the club head, and does not provide the user with information throughout the majority of the swing of the club. In addition, the paths depicted on the mat may force the user into making an unnatural swing.

The prior art does provide apparatuses and methods for teaching a golf swing by using lasers to provide a user with information during the swing of a golf club. The information the user receives, however, may indicate many different things. Lacking in the prior art are methods and apparatuses to provide information to a user during the entire swing of a golf club, especially the follow through portion of the swing of the golf club. Of particular note, the follow through can affect the trajectory of the shot and the spin imparted to the ball upon impact with the club face, causing the ball to either slice or hook. Also lacking in the prior art is an effective means to track the position of the club face during the swing of the club, which is an even more important factor in causing the ball to slice or hook. Finally, the prior art discloses methods of training a user to swing a golf club that are not customizable depending on variables such as the height of the user, the length of the user's golf club, and the natural swing plane of the user. Accordingly, these methods may force users to swing a golf club in an unnatural, inefficient or incorrect manner.

SUMMARY OF THE INVENTION

It is an object of the present invention to disclose a novel method and apparatus for training a user to swing a golf club.

It is another object of the present invention to disclose a novel method and apparatus for training a user to swing a golf club on a correct swing plane.

It is yet another object of the present invention to disclose a novel method and apparatus for training a user to swing a golf club by providing feedback to the user throughout the entire swing of a golf club.

It is still another object of the present invention to disclose a novel method and apparatus for training a user to execute a draw or fade shot by providing the user with information about the position of the club face of the golf club throughout the entire swing of the golf club.

Accordingly, the present invention provides for an apparatus for training a user to correctly swing a golf club, said apparatus comprising a golf club having a shaft; a plurality of lasers movably coupled with said shaft, said lasers producing a plurality of laser beams, the angle defined between each of said laser beams and said shaft being adjustable by a user; a visible guideline positioned on the ground, said laser beams projecting a plurality of laser points on the ground in relation to the guideline throughout a golf swing to thereby provide visual feedback to the user throughout said golf swing.

Additional objects, advantages and novel features of the present invention will be set forth in part in the description which follows, and in part will become apparent to those skilled in the art upon examination of the following, or may be learned from practice of the invention.

DESCRIPTION OF THE DRAWINGS

In the accompanying drawings which form a part of this specification and are to be read in conjunction therewith and in which like reference numerals are used to indicate like parts in the various views.

DESCRIPTION OF THE INVENTION

Figure 1:
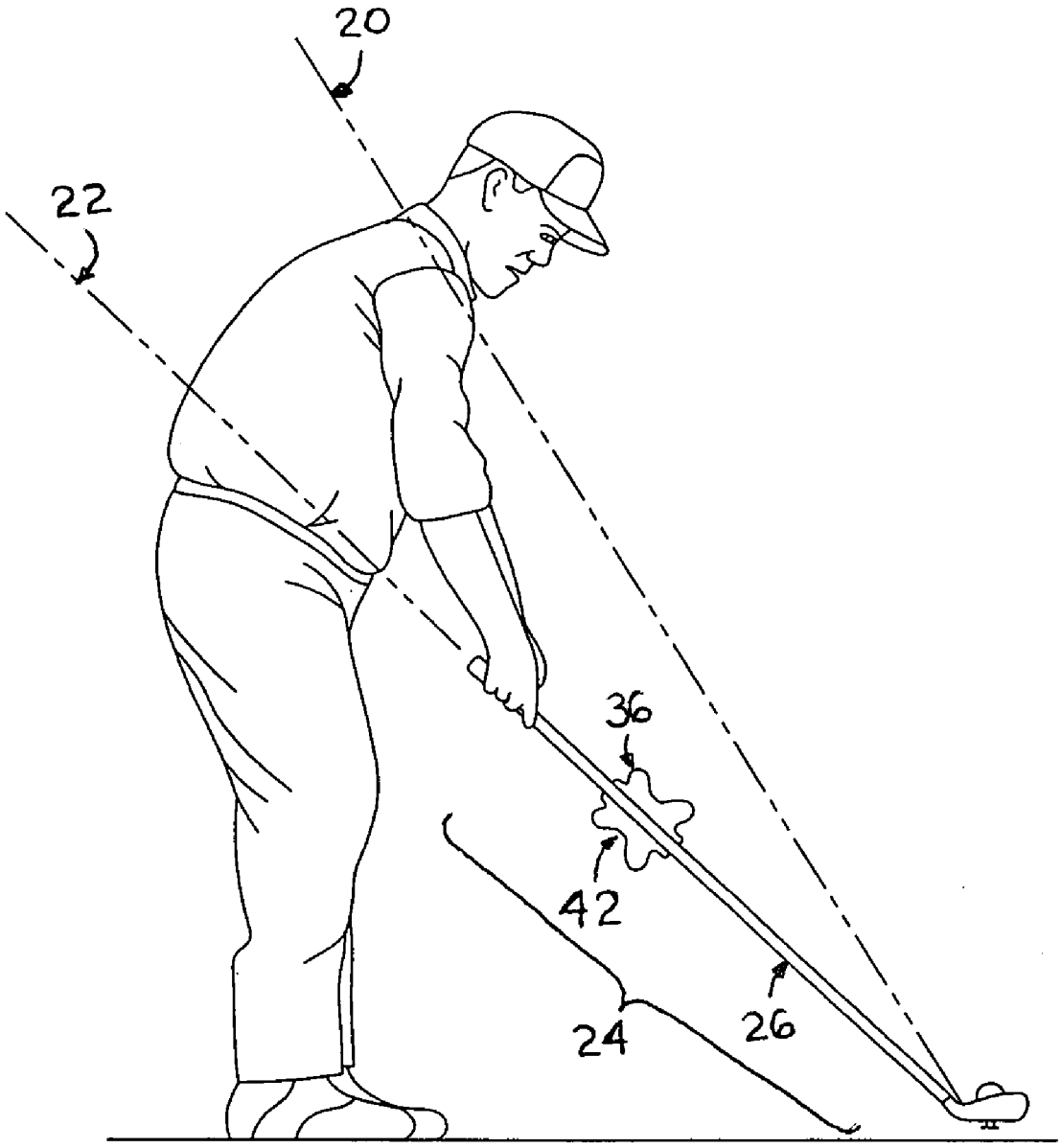
FIG. 1 is a rear elevation view of a golfer and an embodiment of the invention at address.

Swinging a golf club so as to strike a golf ball squarely to produce an accurate shot is a complex process, involving a tremendous amount of hand-eye coordination and years of practice. Experts have broken down the characteristics of a golf swing into nearly every conceivable element thereof. Golf experts generally agree, however, that the success of a golf swing is dependent upon two important variables; the plane on which the golf club is swung and the orientation of the face of the club upon impact with the ball.

Most experts also agree that a correct swing plane for a user to swing a golf club is defined by a plane running from the ball upward across the top of the golfer's shoulders at the point when the golfer addresses the ball prior to the swing. In his book *Five Lessons: The Modem Fundamentals of Golf*, (© 1957, Ben Hogan, published by Simon & Schuster, Inc.) the legendary golfer Ben Hogan defined this correct swing plane as "a large pane of glass that rests on the top of the shoulders as it inclines upward from the ball." This plane is referred to hereafter as the correct swing plane and is illustrated by line 20 in FIG. 1. Ideally, at the top of the backswing of the golf club, the entire golf club should be aligned with the correct swing plane 20. However, the golf club does not start out on this correct swing plane 20. Instead, the golf club starts out on a plane defined by the position of the golf club, specifically the shaft of the club upon address of the ball by the golfer. This plane, hereinafter referred to as the original club plane, is demonstrated and discussed by David Leadbetter in his book *The Golf Swing* (© 1990, David Leadbetter, published by Dutton Books) and is illustrated by line 22 in FIGS. 1 and 2.

In a correct golf swing, the golfer gradually draws the golf club back from the original club plane 22 to the top of the backswing, which should align the golf club with the golfer's correct swing plane 20. From this point, the golfer must swing the golf club back down from the correct swing plane 20 to the original club plane 22 in order to strike the ball. After impact with the ball, the golf club should travel again to a plane matching the correct swing plane 20 at the end of the follow through.

A key component of a correct golf swing, therefore, is learning to swing the golf club in a smooth, gradual manner from the original club plane 22 to the much steeper correct swing plane 20, and then back to the original club plane 22 to strike the ball. The golf club then continues through this impact point and ultimately ends up on a plane matching the correct swing plane 20 at the end of the follow through of the swing. The angle of difference between the original club plane 22 and the correct swing plane 20 is critical to the functioning of the present invention. The correct swing plane 20 and original club plane 22 of each golfer will be different as they are dependent on, among other things, variables such as the height of the golfer, the length of the golf club, the golfer's stance in relation to the ball at address, and the golfers natural swing characteristics. The present invention is embodied in an apparatus that utilizes the angle of difference between the original club plane 22 and the correct swing plane 20 to provide feedback to a user that will allow the user to tailor his or her golf swing to the characteristics of a correct golf swing without forcing the user to alter his or her natural golf swing pattern into conformity with what may be for them a rigid and uncomfortable style.

Another critical aspect of the golf swing is the position of the head of the club and the club face throughout the swing of the club. The golfer must keep the club face in proper position and alignment during the swing so that the club face strikes the ball squarely on impact. If the club face strikes the ball squarely, the ball will tend to travel in a straight line in the direction of the swing. If the club face is out of alignment upon impact, club face will impart a directional spin to the ball upon impact, resulting in the ball curving to either the right or left in flight, known in golfing parlance as either a "slice" or "hook." However, there are times when a golfer needs to hit such a curving shot. Planned, gently curving golf shots are referred to in golfing parlance as either "draw" or "fade" shots. For a right-handed golfer, a slight left to right ball flight is a fade, an extreme left to right ball flight is a slice, a slight right to left ball flight is a draw, and an extreme right to left ball flight is a hook. These shots are extremely difficult for a golfer to learn to execute correctly. The present invention can also be used to teach these shots as well.

Figure 3:
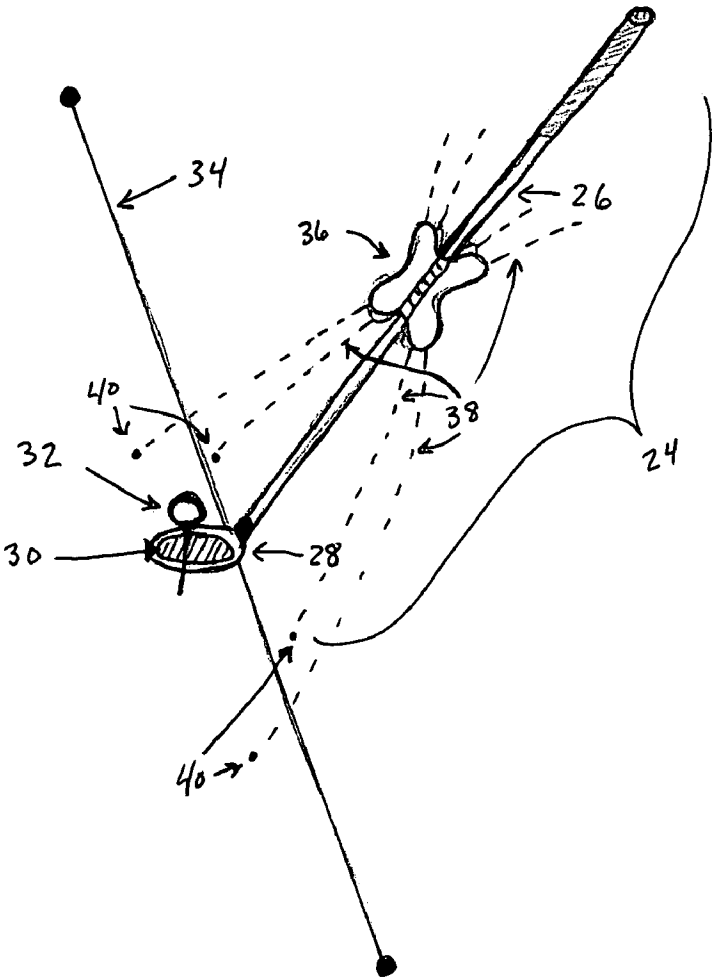
FIG. 3 is a perspective view of the golf club and an embodiment of the invention at address.

The present invention discloses a novel method and apparatus for teaching a user to swing a golf club correctly. As shown in FIG. 3, the apparatus consists of a golf club 24 having a shaft 26 and a club head 28 attached thereto. The club head 28 has a face 30 meant to strike a golf ball 32. The golf ball 32 is positioned next to a guideline 34 shown in FIG. 3 extending along side the golf ball 32. The guideline 34 is positioned in a line parallel to the shaft 26 of the golf club 24 at the point of the shaft 26 of the golf club 24 when the golf club 24 is in position upon the user's address of the golf ball 32. Therefore, as shown in FIGS. 4-7, the guideline is positioned between the user and the golf ball 32. The guideline 34 is aimed in a direct line to the target the user is aiming at (i.e. the flag). An apparatus 36 capable of holding a plurality of lasers is movably attached and securable to the shaft 26 of the golf club 24. Each of the lasers housed within the apparatus 36 are capable of being positioned at a defined angle away from the shaft 26 of the golf club 24. The plurality of lasers housed in the apparatus 36 emit a plurality of laser beams 38 that appear as a plurality of laser points 40 on or near the guideline 34 throughout the swing of the golf club 24. The guideline 34 can consist of any straight, visible, thin item, such as but not limited to a rope, string, a tape measure, tape, or a long, thin piece of plastic. The guideline 34 need not extend for any exact length, but should extend far enough in front of and behind the golf ball 32 so that the user can see the laser points 40 in relation to the guideline 34 with enough clarity to be provided with useful information regarding the position of the golf club 24, the club head 28 and the club face 30 throughout the entire swing of the golf club 24.

Figure 2:
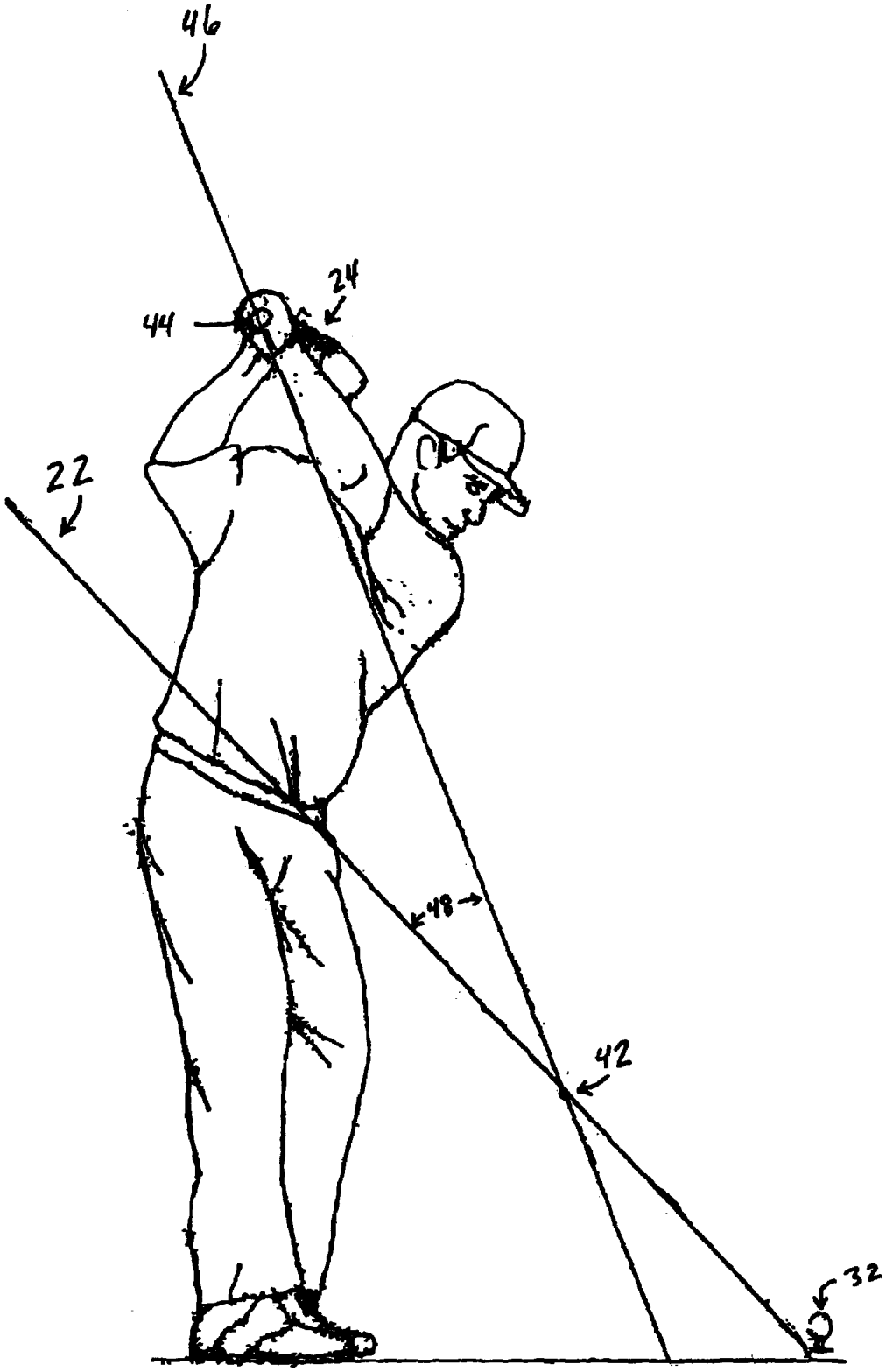
FIG. 2 is a rear elevation view of a golfer and an embodiment of the invention at the top of the backswing.

Determining the angle at which each of each individual laser housed in the apparatus 36 are positioned away from the shaft 26 of the golf club 24 is essential to the practice of the present invention. This angle is calculated by first determining the original club plane 22 of the user. FIG. 1 illustrates a user holding a golf club and addressing a golf ball. As shown in FIG. 1, the original club plane 22 corresponds to the position of the shaft 26 of the golf club 24 relative to the ground upon address of the golf ball 32 by the user. Once the original club plane 22 is determined, a center point 42 is selected along the shaft 26 of the golf club 24 as it rests along the original club plane 22. The user then draws the golf club 24 back to the final point of the backswing of the golf club 24 as shown in FIG. 2, such that the golf club 24 is now in line with the correct swing plane 20 of the user. In this position a second point 44 is determined by the position of the butt end of the club grip in the user's hands. A line can then be drawn between by the center point 42 to the second point 44. An angle is thereby formed by two lines, the first line being a line extending from the center point 42 to the second point 44, and the second line being the line of the original club plane 22. This angle, hereinafter referred to as the laser angle 48 is illustrated in FIG. 2. The laser angle 48 is the measure of the angle at which each individual laser contained within the apparatus 36 is positioned away from the shaft 26 of the club 24, and is therefore essential to the proper functioning of the present invention. For example, if a given user's laser angle 48 is twenty-five degrees, then each laser housed in the apparatus 36 will be positioned at a twenty-five degree angle away from the shaft 26 of the club 24. The laser angle 48 approximates the measure of the angle of difference between the original club plane 22 and the correct swing plane 20 of the user. Because each user will have a unique original club plane 22 and correct swing plane 20 due to the unique sets of variables of each user (e.g., the height of the user, the length of the users clubs and the swing characteristics of each individual user) the laser angle 48 will be different for each user of the present invention. The equation used to determine the laser angle therefore allows the user to customize the present invention to their individual swing characteristics. Since the present invention is based on fundamental principles of a golf club swing, users can more easily and naturally adjust their golf swing to optimize the performance and efficiency of their swing.

Figure 12:
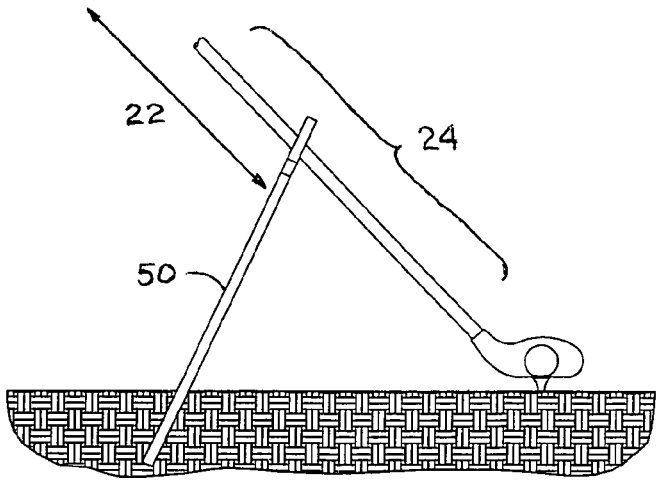
FIG. 12 is a depiction of a golf club supported by a crutch.

As shown in FIG. 12, the determination of the laser angle 48 by a user can be easily achieved through the use of a crutch 50 to hold the golf club 24 in place once the user has positioned the golf club 24 in the original club plane 22. Once the golf club 24 is fixed in the original club plane 22 by using the crutch 50, the user can then take a second club and draw it back to the apex of their backswing to the correct swing plane 20. Plotting the points to calculate the angle between the line of the original club plane 22 and the line created by center point 42 and second point 44 as shown in FIG. 2 can be easily accomplished by either a direct measurement as the user stands in position, or the user can be photographed from a position such that the points can be determined and the laser angle 48 can be measured from the photograph.

Figure 9:
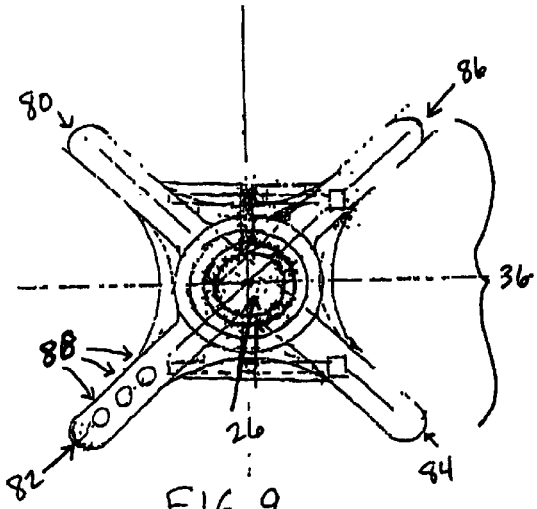
FIG. 9 is a top plan view of the apparatus for holding a plurality of lasers on the shaft of the golf club.
Figure 10:
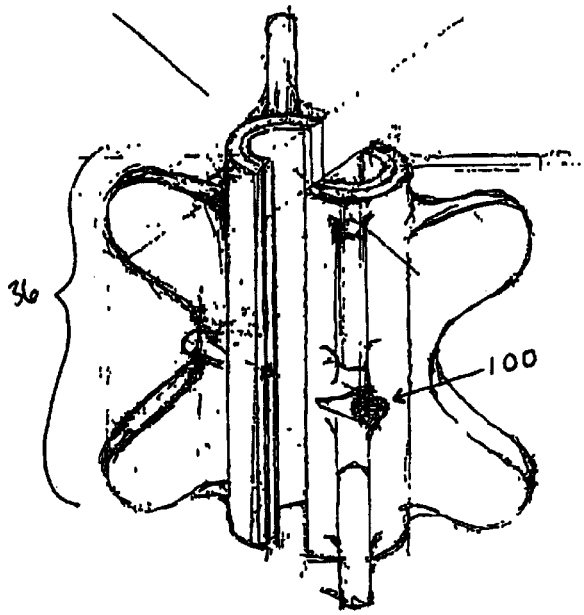
FIG. 10 is an exploded view of the apparatus for holding a plurality of lasers, with details of construction illustrated.
Figure 11:
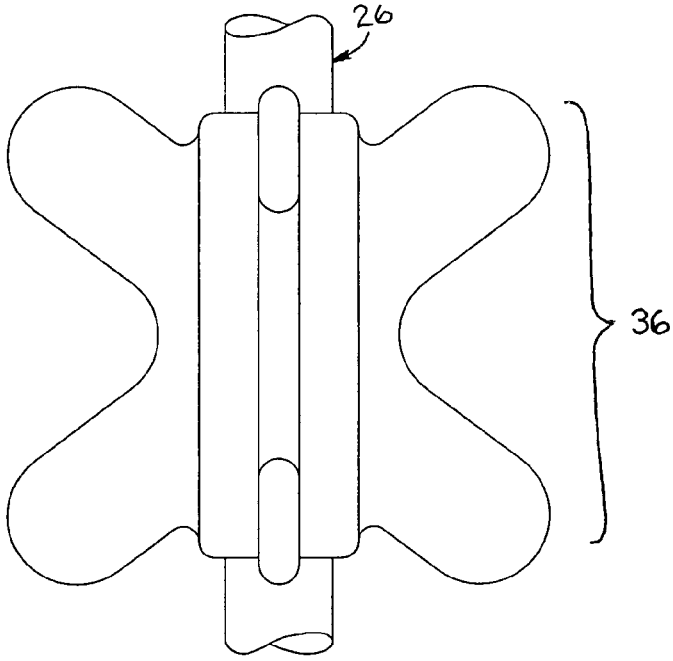
FIG. 11 is a perspective view of the apparatus for holding a plurality of lasers on the shaft of the golf club.
Figure 13:
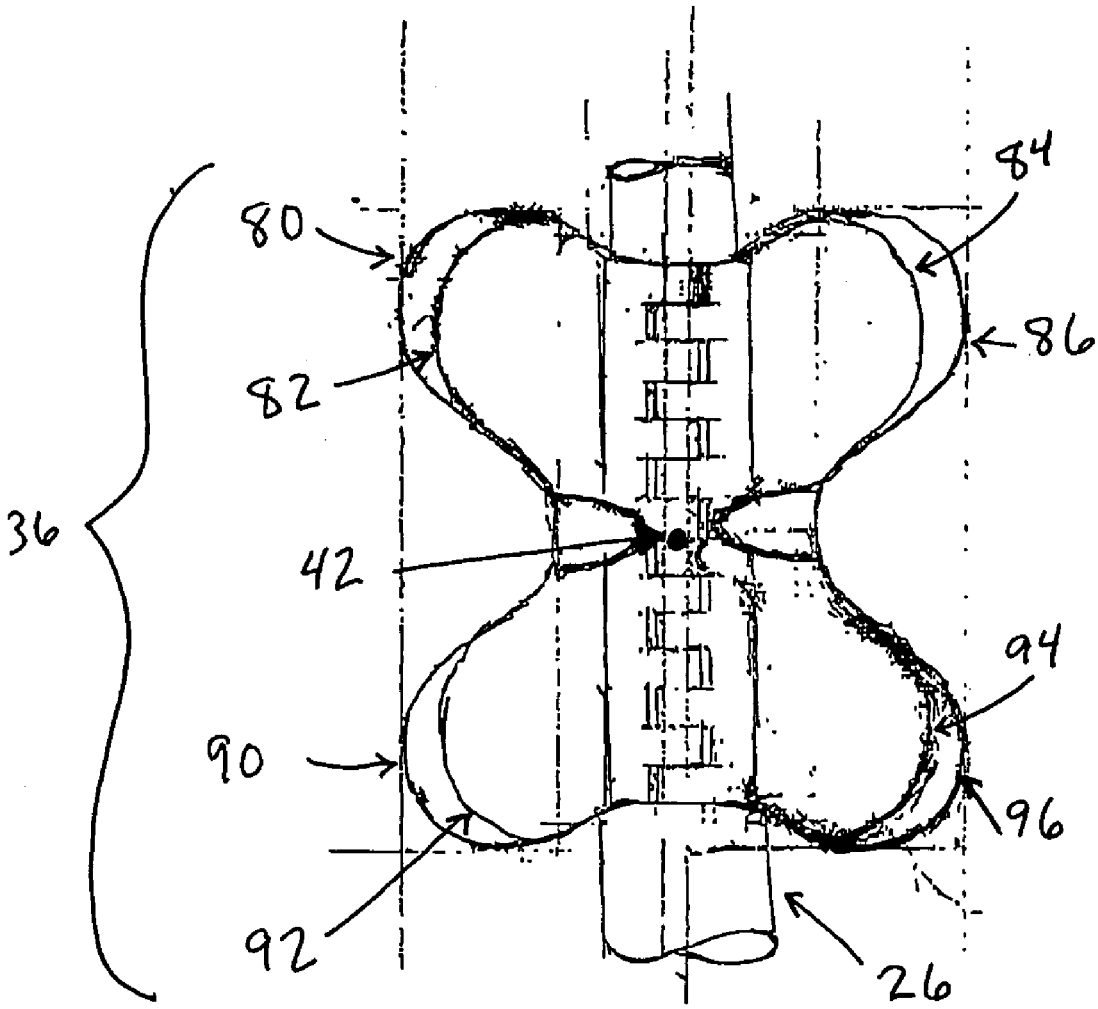
FIG. 13 is a perspective view of the apparatus for holding a plurality of lasers on the shaft of the golf club.

Once the laser angle 48 is determined, each laser contained within the apparatus 36 is fixed at an angle equal to the laser angle 48 away from the shaft 26 of the golf club 24. An apparatus capable of holding the plurality of lasers in a fixed position at the laser angle 48 is illustrated in detail in FIGS. 8, 9, 10, 11 and 13. As shown in FIG. 1, an apparatus 36 capable of holding a plurality of lasers is attached to the golf club 24. The center of the apparatus 36 is aligned with the center point 42 of the golf club 24. As shown in FIG. 13, this apparatus 36 attaches around the shaft 26 of the golf club 24. Ideally, the apparatus 36 is formed from molded plastic and is fabricated in two pieces, as shown in FIG. 10. The two pieces have means allowing them to be attached and detached from each other and from the shaft 26 of the golf club 24. The two pieces are attached around the shaft 26 of the golf club 24, and are capable of being held in a specific position along the shaft 26 of the golf club 24. As shown in FIG. 10, the two pieces of the apparatus 36 may be attached together and held in place on the shaft 26 of the golf club 24 by a screw 100 passing through one piece and securably holding it to the other piece. A plurality of screws may also be used to hold the two pieces of the apparatus 36 together. As shown in FIG. 13, the two pieces of the apparatus 36 may also be hinged together at one side and held together and in place on the shaft 26 by a mechanism including but not limited to a clasp, latch or screw on the opposite side that is capable of being tightened so as to fix the apparatus 36 to the shaft 26. Said mechanism should also be capable of being loosened so as to allow the apparatus 36 to be moved to various positions on the shaft 26, whereupon said mechanism can be re-tightened so as to hold the apparatus 36 in its new position on the shaft 26. In order to provide for a secure fit between the shaft 26 and the apparatus 36, the inner channel of the apparatus 36 may be lined with rubber, silicone or other similar tacky material. This design allows the present invention to be used with any one of the user's golf clubs, and does not require the purchase of a special golf club in order to practice and use the present invention.

The apparatus 36 is used to movably attach a plurality of lasers to the golf club 24 such that the plurality of lasers can be easily and effectively oriented to the laser angle 48 of the user. The preferred embodiment of the apparatus 36 is a double butterfly configuration illustrated in FIGS. 9, 10, 11 and 13. This double butterfly configuration is comprised of eight wings. As shown in FIG. 13, four of the wings, 80, 82, 84 and 86 point up and away from the ground at address, and four of the wing, 90, 92, 94 and 96 point down toward the ground at address. Each wing contains a plurality of channels. As shown in FIG. 9, each wing contains a plurality of channels, 88. FIG. 9 depicts the optimal design incorporating three channels in the plurality of channels 88. Each individual channel of said plurality of channels 88 is formed at a slightly greater angle away from the shaft 26. For example, the channel nearest the shaft 26 might be set at a fifteen degree angle away from the shaft 26, the middle channel might be set at a twenty degree angle away from the shaft, and the channel farthest from the shaft 26 might be set at a twenty five degree angle away from the shaft. Each channel is capable of securably holding a device capable of producing a laser beam, optimally a small laser pointer apparatus such as the Miraclebeam™ BTK-1 Single Head Laser Pointer, which can be purchased from Beam of Light Technologies, 10117 SE Sunnyside Road, Suite #F, MB324, Clackamas, Oreg. 97015, USA, or via their website, www.z-bolt.com. Alternatively, the channels could also hold a small apparatus capable of producing a beam of light, such as the Maglite® Solitaire® Flashlight, which can be purchased from MAG Instrument, Inc., 1635 South Sacremento Avenue, P.O. Box 50600, Ontario, Calif. 91716, USA, or via their website, www.maglite.com.

Each channel of the plurality of channels 88 is formed in the apparatus 36 such that it is in alignment with and is angled towards the center of the shaft 26 of the golf club 24. In addition, each channel will also be in alignment with a channel on the farthest diagonal opposing wing of the bottom half of the apparatus. For example, in FIG. 13, the outermost channel of wing 80 will be in alignment with the outermost channel of wing 94, such that a rod inserted into the outermost channel of wing 80 would continue to pass directly through the center of the shaft of the golf club and would pass directly through the outermost channel of wing 98. Likewise, the middle and innermost channels of wing 80 will be in alignment with the middle and innermost channels of wing 98 respectively. The channels of wing 84 are in alignment with the corresponding channels of wing 90, the channels of wing 86 are in alignment with the corresponding channels of wing 92, and the channels of wing 82 are in alignment with the corresponding channels of wing 96.

Lasers are placed in the channels 88 apparatus 36, specifically in the channel most closely approximating the measurement of the laser angle on each wing of the apparatus 36. The lasers may be held in position in the appropriate channel through any number of means whereby an item can be fixed within a housing. For example, each channel on the apparatus 36 may be formed with a threaded screw conduit in each channel such that a screw can be inserted in and threaded through the conduit, thereby protruding into the channel, whereupon said screw would push against the laser and effectively clamp it into place within the channel. Also, forming the rear end of each laser with screw threads, and forming corresponding screw threads within the channels of the wings of the apparatus 36 would allow each laser to be screwed into the apparatus 36 and would serve to properly secure the lasers within the channels.

Figure 8:
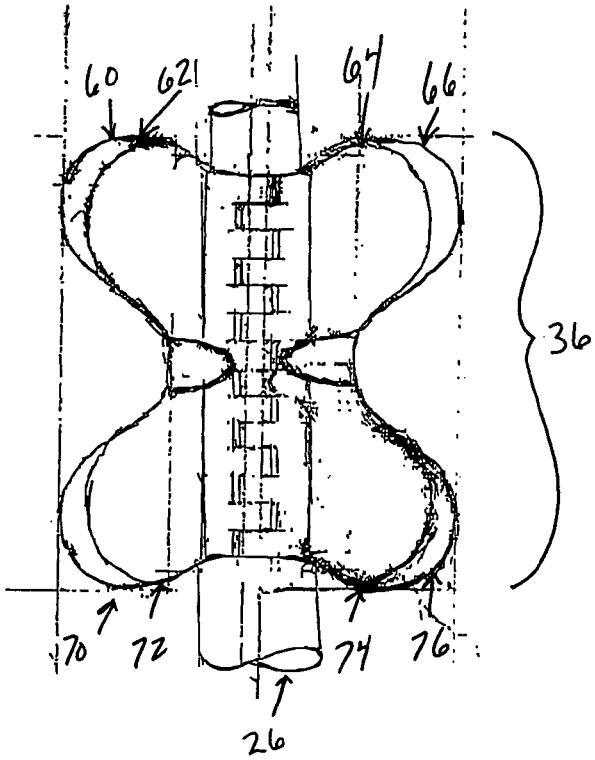
FIG. 8 is a perspective view of the apparatus for holding a plurality of lasers on the shaft of the golf club.

Optimally, eight (8) lasers producing laser points are required for the functioning of the present invention, as shown in FIG. 8. The configuration of the lasers is illustrated in FIG. 8. In this optimal configuration, four lasers producing laser points project up from the golf club; laser producing laser point 60 (on the forward top right of the apparatus, housed in wing 80), laser producing laser point 62 (on the forward top left of the apparatus, housed in wing 82), laser producing laser point 64 (on the rear top left of the apparatus, housed in wing 84) and laser producing laser point 66 (on the rear top right of the apparatus, housed in wing 86). Four lasers producing laser points project down towards the ground; laser producing laser point 70 (on forward bottom right of the apparatus, housed in wing 90), laser producing laser point 72 (on the forward bottom left of the apparatus, housed in wing 92), laser producing laser point 74 (on the rear bottom left of the apparatus, housed in wing 94) and laser producing laser point 76 (on the rear bottom right of the apparatus, housed in wing 96). Wings 80 and 82 are fixed at a 45 degree angle away from each other, as are wings 84 and 86. Likewise, wings 90 and 92 and wings 94 and 96 are also fixed at 45 degree angles away from each other. These angles are also illustrated by FIG. 9.

As previously stated, the apparatus 36 should ideally be centered on the center point 42 of the shaft 26 of the golf club 24. However, because the channels 88 of the apparatus 36 are formed at specific, predefined angles away from the shaft 26 of the golf club 24, precise positioning of lasers in the channels to the exact laser angle 48 of the user may not be possible if the apparatus 36 is not moved from the center point 42. Moving the apparatus 36 above or below the center point 42 of the golf club 24 will change the trajectory of the lasers projecting from the apparatus 36 in relation to the guideline 34. In the event that a users laser angle 48 is not matched by any of the angles of the channels in the wings of the apparatus 36 (and therefore the lasers housed therein) the user may place the lasers in the channels with the angle most closely matching his or her laser angle 48 and move the apparatus 36 up or down the shaft 26 of the golf club 24 to the point that laser points project from the apparatus 36 at a correct trajectory for the users swing. Any differential between the final position of the apparatus 36 and the center point 42 if the apparatus is shifted away from the center point 42 will be compensated for by the change in trajectory of the laser points 38. Thus, the apparatus 36 may be even further optimized to the user's swing characteristics.

The user receives feedback by observing the points generated by the lasers contained in the apparatus 36 in relation to the guideline 34. Optimally, the laser points should follow the path shown by the guideline 34 throughout the swing of the golf club 24. Observation of the laser points as they appear on the guideline 34 during the users swing of the club thus provides feedback and information to the user regarding both the position of the golf club 24 and the orientation of the club head 28 club face 30 throughout the swing of the golf club 24.

Figure 4A:
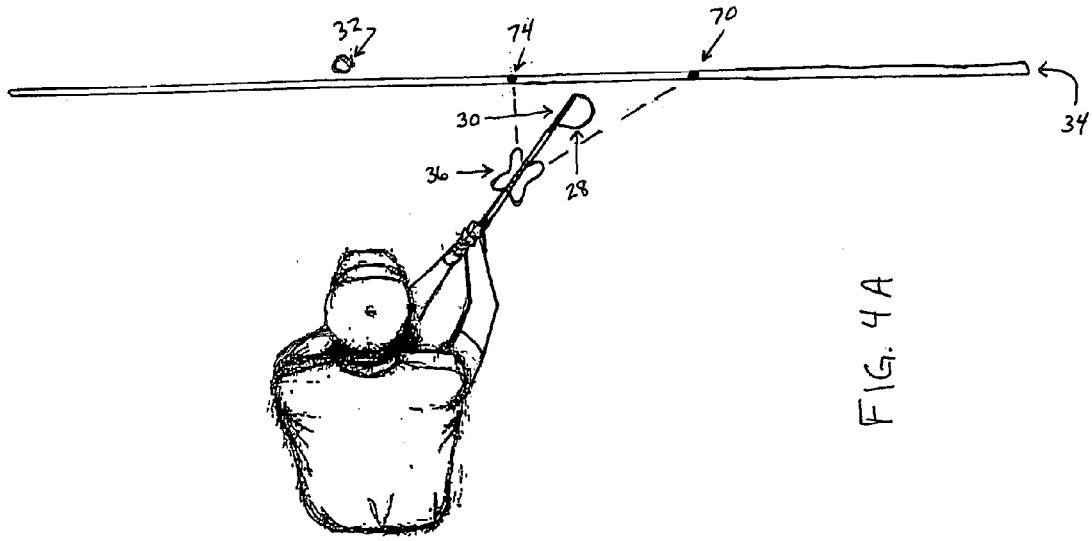
FIG. 4A is a top plan view of a golfer and an embodiment of the invention at the beginning of the backswing.
Figure 4:
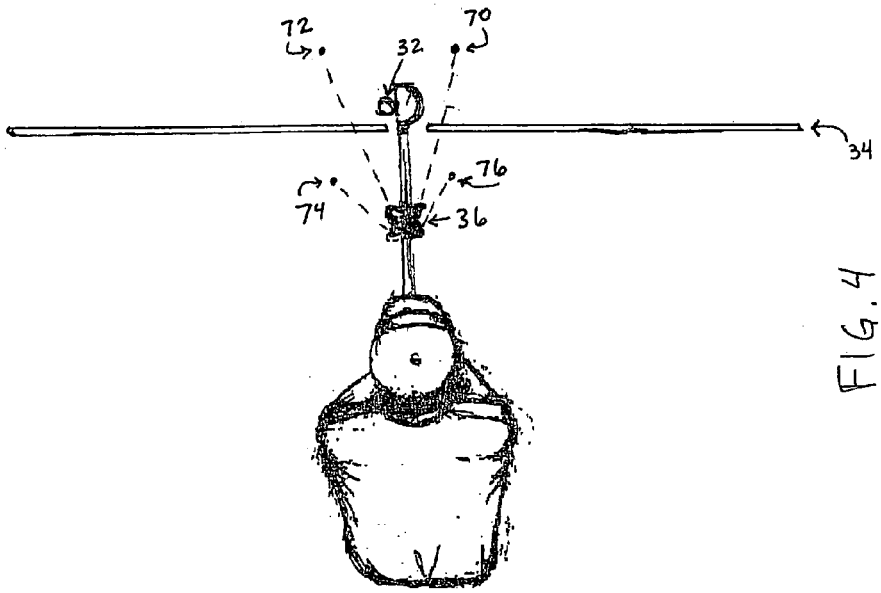
FIG. 4 is a top plan view of a golfer and an embodiment of the invention at address.
Figure 5A:
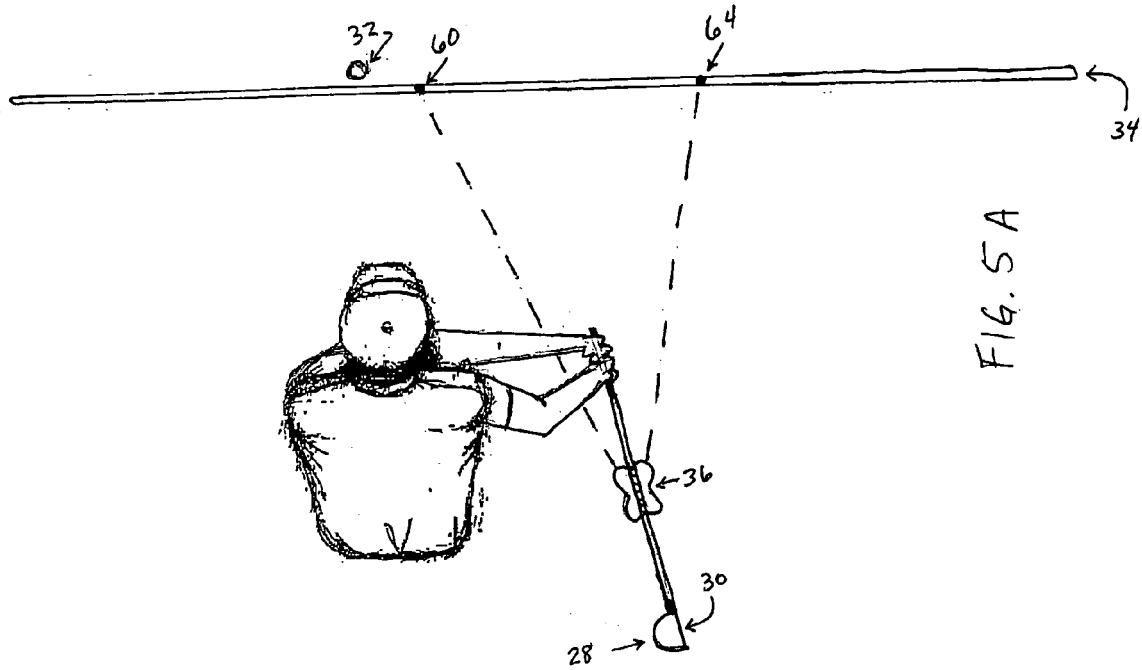
FIG. 5A is a top plan view of a golfer and an embodiment of the invention three-quarters of the way through the backswing.
Figure 5:
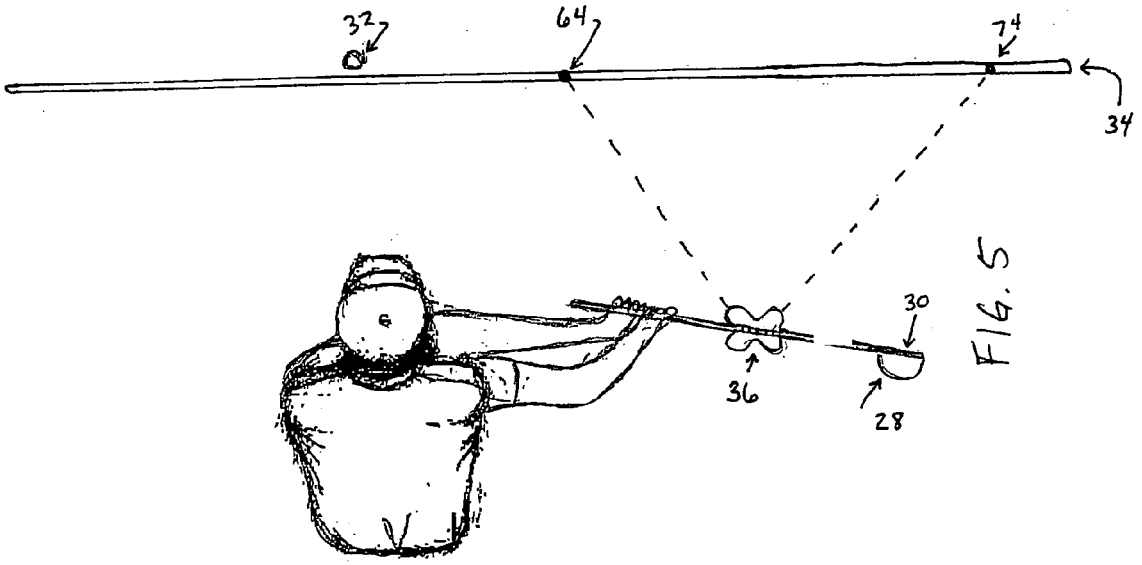
FIG. 5 is a top plan view of a golfer and an embodiment of the invention halfway through the backswing.

FIGS. 4, 4A, 5, 5A, 6, 6A, 7, 7A and 7B illustrate a right-handed user using the present invention in an ideal golf swing wherein the swing is kept in proper alignment and the club head 28 and club face 30 are kept in correct orientation throughout the swing. As shown in FIG. 4, upon address of the ball, laser points 70, 72, 74 and 76 form a square pattern centered on the golf ball 32. As the user draws the golf club 24 back from the golf ball 32 approximately one quarter of the way through the backswing of the golf club 24, the club head 28 should be rotated approximately one-eighth turn clockwise, whereupon laser points 70 and 74 should project on the guideline 34, as shown in FIG. 4A. As the user progresses through the backswing of the golf club 24 to the halfway point of the backswing (at which point the golf club 24 should be even with the waist of the user), the club head 28 should again rotate approximately one-eighth turn clockwise, and laser points 64 and 74 should project on the guideline 34, as shown in FIG. 5. As the user draws the golf club 24 back further to the three-quarters point of the backswing, as illustrated in FIG. 5A, laser points 64 and 60 should project on the guideline 34. At the top of the backswing, shown in FIG. 6, laser points 70 and 60 should project on the guideline 34.

As the user begins the downswing of the golf club 24, laser points 60 and 70 continue to project laser points on the guideline 34 until the golf club 24 is drawn to the three-quarters point of the backswing, shown in FIG. 5A, whereupon laser points 60 and 64 appear on the guideline 34. As the club is drawn down further towards the ball it reaches the halfway point of the backswing, illustrated in FIG. 5, and laser points 74 and 64 appear on the guideline 34. As the user continues the downswing, the golf club 24 and club head 28 is rotated approximately one-eighth turn counterclockwise, and laser points 70 and 74 appear on the guideline as shown in FIG. 4A. The golf club 24 and club head 28 are then again rotated approximately one-eighth turn counterclockwise until the club face 30 impacts the golf ball 32.

Figure 6A:
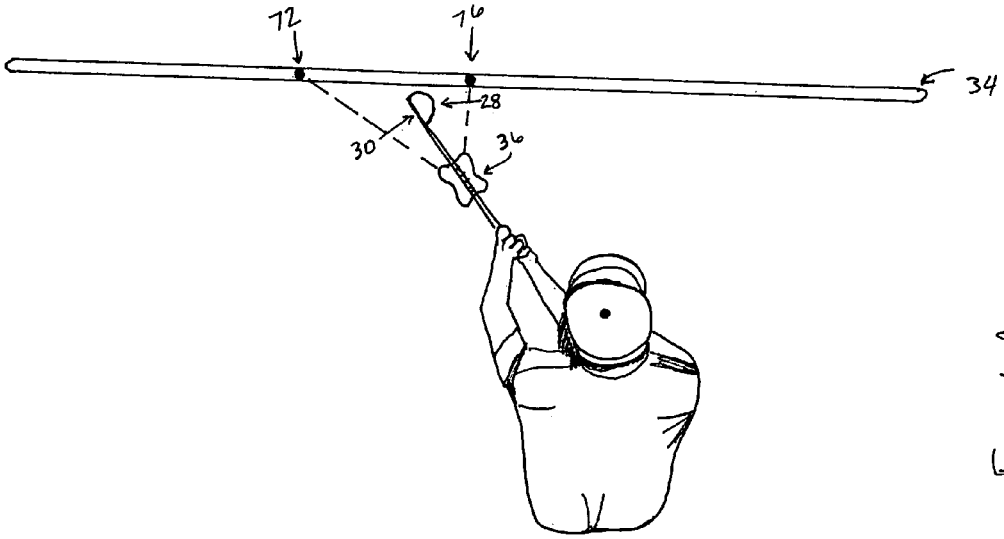
FIG. 6A is top plan view of a golfer and an embodiment of the invention at the beginning of the follow through swing.
Figure 6:
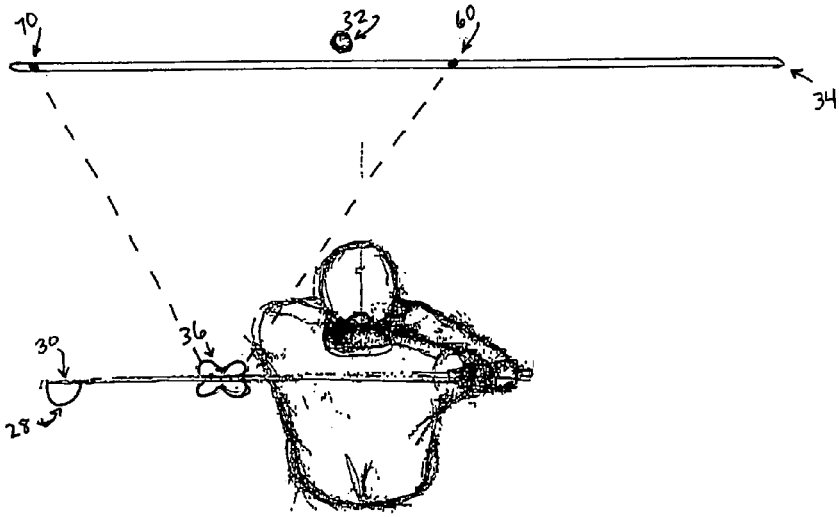
FIG. 6 is a top plan view of a golfer and an embodiment of the invention at the top of the backswing.
Figure 7:
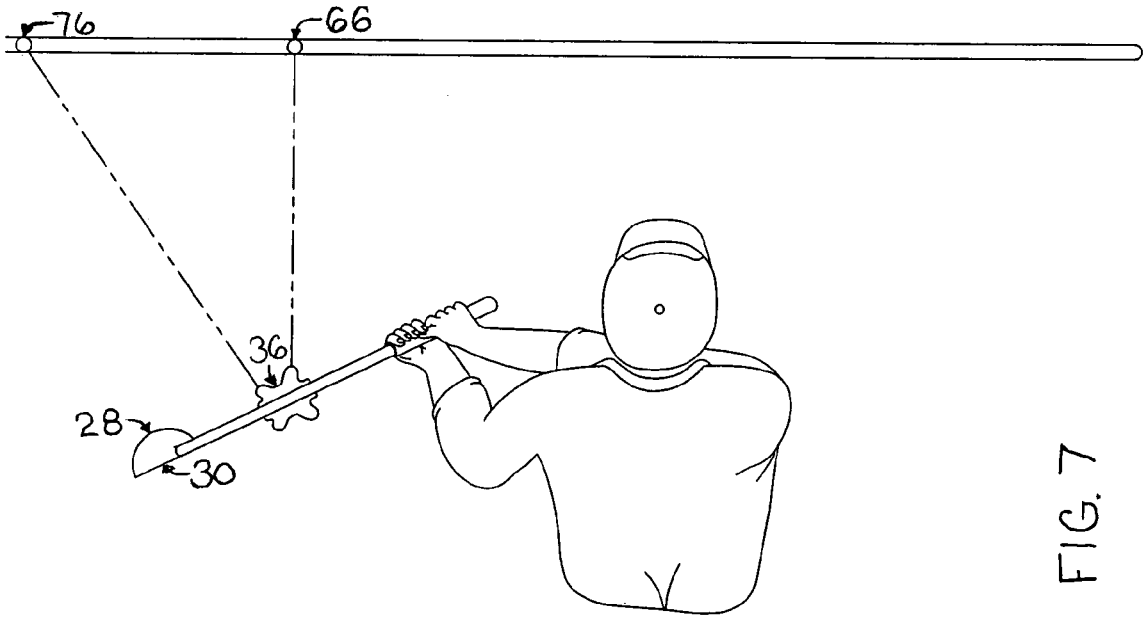
FIG. 7 is a top plan view of a golfer and an embodiment of the invention half way through the follow through swing.
Figure 7A:
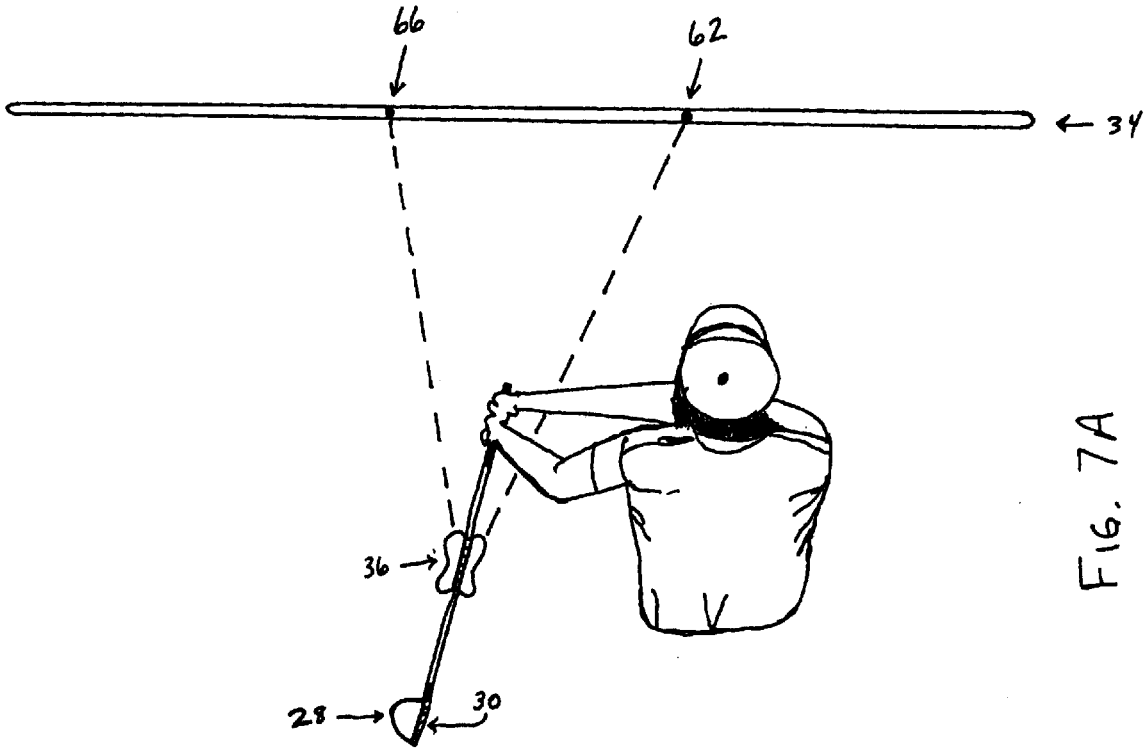
FIG. 7A is a top plan view of a golfer and an embodiment of the invention three-quarters of the way through the follow through swing.
Figure 7B:
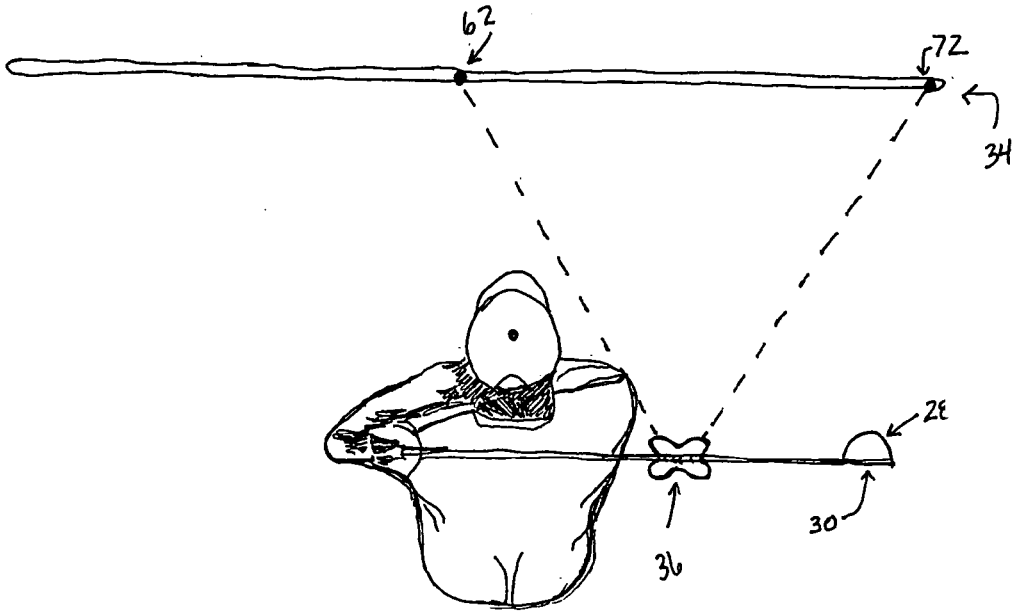
FIG. 7B is a top plan view of a golfer and an embodiment of the invention at the top of the follow through swing.

As shown in FIG. 4, upon impact of the club face 30 with the golf ball 32, lasers 70, 72, 74 and 76 will again form a square centered a on the golf ball 32. As the user continues the follow through swing of the golf club 24 after impact with the golf ball 32, laser points 72 and 76 should project on the guideline 34, as shown in FIG. 6A. At the midway point of the follow through swing, laser points 76 and 66 should appear on the guideline 34. At the three quarters point of the backswing, as shown in FIG. 7A, laser points 66 and 62 should appear on the guideline 34. Finally, at the top of the follow through as shown in FIG. 7B, laser points 72 and 62 should project on the guideline 34.

Feedback is provided to the user of the present invention throughout the entire swing of a golf club 24 as the user observes the position of the laser points created by the lasers contained within the apparatus 36 in relation to the guideline 34. If the user draws the golf club 24 back at an improper angle from the golf ball 32 (for example, an angle either too steep or too shallow) the laser points generated by the lasers in the apparatus 36 will not be in alignment with the guideline 34, and will not project on the guideline. Also, even if the user maintains a proper swing plane of the golf club 24, the present invention provides feedback about the position of the club head 28 and club face 30 as well. If the user rotates the golf club 24 too much or too little during the swing, the laser points will be out of alignment with the guideline 34, and again will not appear on the guideline.

This feedback is useful to a user because it will allow the user to tailor the mechanics of his or her shot to optimize its effectiveness. For example, FIG. 5 depicts the proper positioning of the laser points 40 as the user draws the golf club 24 back to a quarter swing position. If the user's swing plane were too shallow at this point, laser points 64 and 74 would appear in front of the guideline 34, or on the opposite side of the guideline 34 from the user. If the user's swing plane were too steep, laser points 64 and 74 would project behind the guideline 34, or between the user and the guideline 34. If the club head 28 and club face 30 were out of position, the points from lasers 64 and 74 would appear on either side of the guideline 34, one in front of the guideline 34 and one in back. This feedback would indicate to the user how their swing characteristics would need to be modified in order to correct and optimize their swing. Essentially, all the user needs to do is aim to keep the laser points in contact with the guideline 34 in the proper sequence throughout the backswing, downswing and follow through swing.

Figure 14:
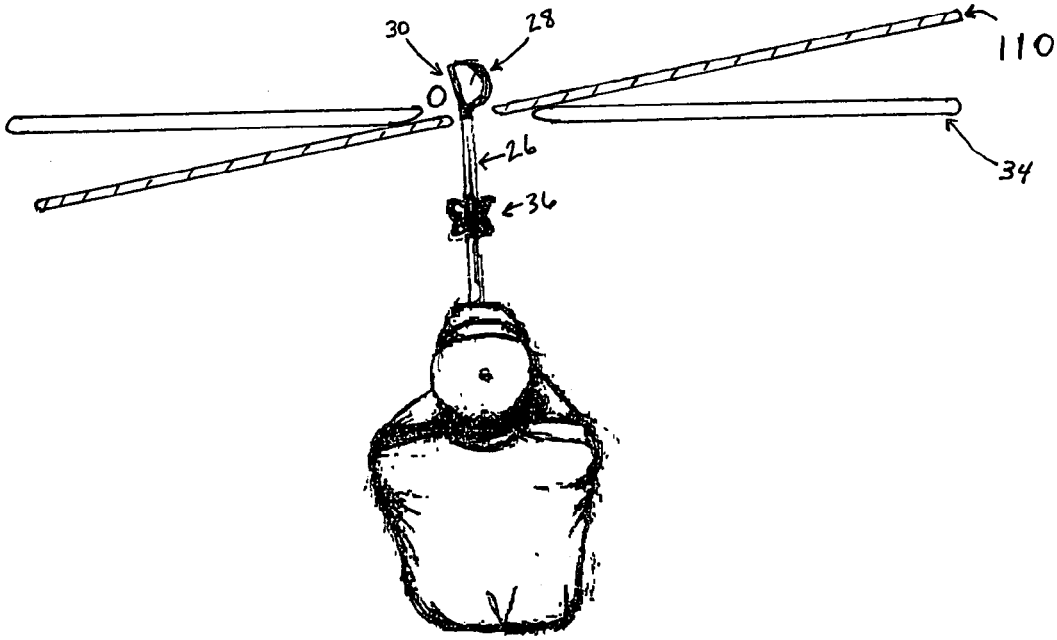
FIG. 14 is a top plan view of a golfer and the invention at address during a draw shot.
Figure 15:
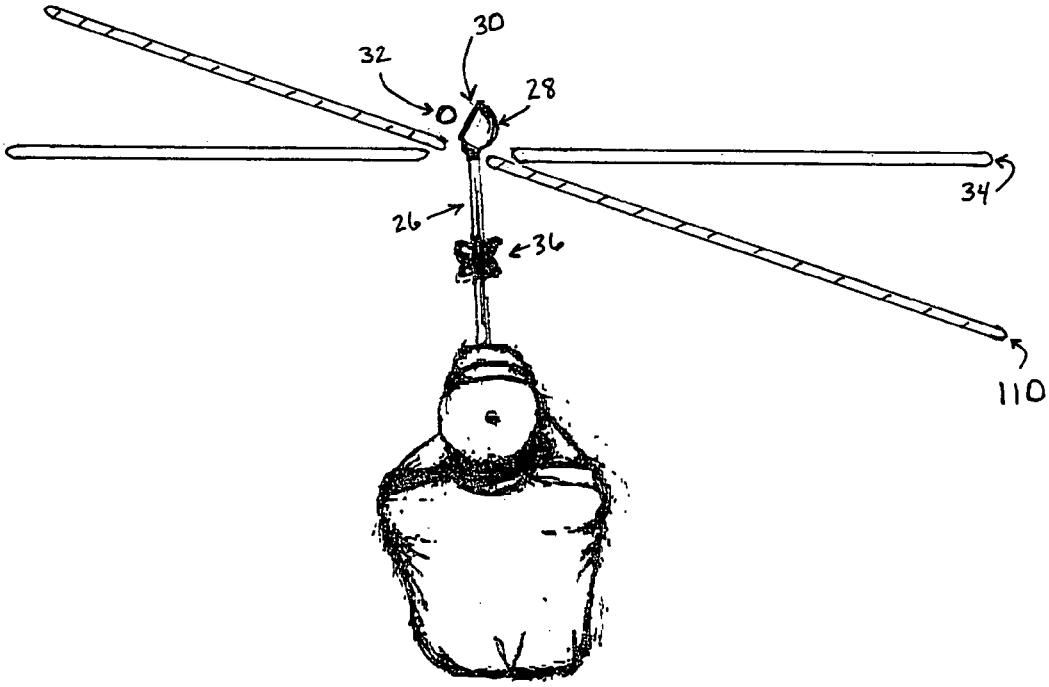
FIG. 15 is a top plan view of a golfer and the invention at address during a fade shot.

The present invention can also be used to train a user to effectively hit a fade or draw shot. This is accomplished by having the user rotate the golf club 24 in his or her hands so that the club face 30 is at an angle to the golf ball 32 throughout the swing of the golf club 24 and on impact of the club face 30 with the golf ball 32. The guideline 34 will remain in its normal position, parallel with the user's shoulders at address and in a direct line from the golf ball 32 to the intended target. The user therefore must adjust the position of the apparatus 36 on the shaft of the golf club 24 so that the lasers of the apparatus will project laser points on the guideline 34 as described above. Although it is not necessary, a user may wish to use a second guideline 110 as shown in FIGS. 14 and 15 to help align the club face 30 at the appropriate angle to the golf ball 32. FIG. 14 illustrates the set up for a draw shot, and FIG. 15 illustrates the set up for a fade shot. This second guideline 110 will also help the user visualize the initial flight of the golf ball 32. When placed in position along the intended initial flight trajectory of the golf ball 32, this second guideline 110 can help the user properly align the club face 30 for the fade or draw shot, as the club face 30 should be at a ninety degree angle to the second guideline 110.

Once the apparatus 36 is oriented such that the club face 30 is being held at the appropriate angle to the golf ball 32, the present invention and method are practiced as described above, (i.e. tracking the laser points along the guideline 34 and keeping the golf club 24 in such a swing plane and the club head 28 in such an orientation so that the laser points follow along the guideline 34 as previously described). Upon impact, the club face 30 will strike the golf ball 32 at an angle of greater or less than ninety degrees, and accordingly, this will result in a spin being imparted to the golf ball 32 by the club face 30 upon impact, thus causing the golf ball 32 to curve in flight. Orienting the second guideline 110 to the left of the target, as shown in FIG. 14, will cause the user to orient the golf club 24 in their hands such that the club face 30 is angled toward the user (at an angle of less than ninety degrees to the guideline 34 and the golf ball 32). Upon striking the golf ball 32, the club face 30 will impart a counterclockwise spin to the golf ball 32, which will cause the golf ball 32 to curve toward the golfer in flight, producing a draw shot. Orienting the second guideline 110 to the right of the target will cause the user to orient the golf club 24 in their hands such that the club face 30 is angled away from the user (at an angle of greater than ninety degrees to the guideline 34 and the golf ball 32). Upon striking the golf ball 32, the club face will impart a clockwise spin to the golf ball 32, which will cause the golf 32 to curve away from the user in flight, producing a fade shot.

What is claimed is:

1. An apparatus for training a user to correctly swing a golf club, said apparatus comprising:

(a) a golf club having a shaft;

(b) a plurality of lasers movably coupled with said shaft, said plurality of lasers producing a plurality of laser beams, the angle between each of said plurality of laser beams and said shaft being adjustable by said user;

(c) a visible guideline positioned on the ground, whereby said plurality of laser beams project a plurality of laser points on the ground in relation to said visible guideline throughout an entire non-putting golf swing to thereby provide visual feedback to said user throughout said entire non-putting golf swing.

2. An apparatus as specified in claim 1 wherein said plurality of lasers is eight lasers.

3. An apparatus as specified in claim 1 wherein said plurality of lasers are movably coupled with said shaft by a plurality of swing arms attached to said shaft and capable of being positioned upwards or downwards on said shaft of said golf club.

4. An apparatus as specified in claim 1 wherein said plurality of lasers are movably coupled with said shaft by a plastic housing unit capable of holding said plurality of lasers at set positions on said shaft and capable of being positioned upwards or downwards on said shaft of said golf club.

5. An apparatus as specified in claim 1 wherein said angle is determined by the angle of difference between the plane of said shaft of said golf club on address of the ball and a line determined by the position of said golf club at said user's correct swing plane and a given point on said shaft of said golf club upon address of said ball.

6. An apparatus for training a user to correctly swing a golf club to hit a fade or draw golf shot comprising:

(a) a golf club having a shaft;

(b) a plurality of lasers movably coupled with said shaft, said plurality of lasers producing a plurality of laser beams, the angle defined between each of said plurality of laser beams and said shaft being adjustable by said user;

(c) a visible guideline positioned on the ground, whereby said plurality of laser beams project a plurality of laser points on the ground in relation to said visible guideline throughout an entire non-putting golf swing to thereby provide visual feedback to the user throughout said entire non-putting golf swing.

7. An apparatus as specified in claim 6 wherein said plurality of lasers is eight lasers.

8. An apparatus as specified in claim 6 wherein said plurality of lasers are movably coupled with said shaft by a plurality of swing arms attached to said shaft and capable of being positioned upwards or downwards on said shaft of said golf club.

9. An apparatus as specified in claim 6 wherein said plurality of lasers are movably coupled with said shaft by a plastic housing unit capable of holding said plurality of lasers at set positions on said shaft and capable of being positioned upwards or downwards on said shaft of said golf club.

10. An apparatus as specified in claim 6 wherein said angle is determined by the angle of difference between the plane of said shaft of said golf club on address of the ball and a line determined by the position of said golf club, at said user's correct swing plane and a random point on said shaft of said golf club upon address of said ball.

11. A method for training a user to correctly swing a golf club comprising:

(a) movably coupling a plurality of lasers to the shaft of a golf club, said plurality of lasers producing a plurality of laser beams, the angle defined between each of said plurality of laser beams and said shaft being adjustable by said user;

(b) placing a visible guideline on the ground such that said plurality of lasers projects a plurality of laser points on the ground in relation to said visible guideline throughout an entire non-putting golf swing;

(c) observing the position of said plurality of laser points in relation to said visible guideline throughout said entire non-putting golf swing; and (d) modifying the golf club swing techniques of said user so that said plurality of laser points appear on the path defined by said visible guideline throughout said entire non-putting golf swing.

12. A method as specified in claim 11 wherein said plurality of lasers is eight lasers.

13. A method as specified in claim 11 wherein said angle is determined by the angle of difference between the plane of said shaft of said golf club on address of the ball and a line determined by the position of said golf club at said user's correct swing plane and a given point on said shaft of said golf club upon address of said ball.

* * * * *